US008598499B2

(12) United States Patent
Wuchert

(10) Patent No.: US 8,598,499 B2
(45) Date of Patent: Dec. 3, 2013

(54) ROLL-OUT THERMAL ENVELOPE ROOF DE-ICING SYSTEM

(76) Inventor: David B. Wuchert, Dolores, CO (US)

( * ) Notice: Subject to any disclaimer, the term of this patent is extended or adjusted under 35 U.S.C. 154(b) by 59 days.

(21) Appl. No.: 13/213,816

(22) Filed: Aug. 19, 2011

(65) Prior Publication Data

US 2012/0043310 A1 Feb. 23, 2012

Related U.S. Application Data

(60) Provisional application No. 61/375,509, filed on Aug. 20, 2010.

(51) Int. Cl.
*H05B 1/02* (2006.01)
*H05B 3/34* (2006.01)

(52) U.S. Cl.
USPC ..... 219/507; 219/494; 219/553; 219/544; 219/549; 219/528

(58) Field of Classification Search
CPC ..... H05B 1/02; H05B 3/34
USPC ..... 219/494, 497, 507, 508, 213, 528, 541, 219/544, 549, 553
See application file for complete search history.

(56) References Cited

U.S. PATENT DOCUMENTS

| | | | | |
|---|---|---|---|---|
| 3,521,029 | A * | 7/1970 | Toyooka et al. | 219/201 |
| 6,294,768 | B1 * | 9/2001 | Liebich | 219/528 |
| 6,348,673 | B2 * | 2/2002 | Winters | 219/213 |
| 6,653,607 | B2 * | 11/2003 | Ellis et al. | 219/528 |
| 6,727,471 | B2 * | 4/2004 | Evans et al. | 219/213 |
| 7,139,471 | B1 * | 11/2006 | Durham | 392/437 |
| 8,258,443 | B2 * | 9/2012 | Caterina et al. | 219/530 |
| 2002/0040898 | A1 * | 4/2002 | Von Arx et al. | 219/535 |
| 2002/0040901 | A1 * | 4/2002 | Laken et al. | 219/544 |

OTHER PUBLICATIONS

Emerson Industrial Automation, EGS Electrical Group, at http://www.emersonindustrial.com/en-us/egselectricalgroup/products/Heating-Cables/Residential-Heating-Cables/Residential-Pipe-Tracing/Freeze-Free-Cable-Plugs/Pages/default.aspx, Oct. 27, 2011.

* cited by examiner

*Primary Examiner* — Mark Paschall
(74) *Attorney, Agent, or Firm* — Simpson & Simpson, PLLC

(57) ABSTRACT

A flexible roll-out thermal system, including: a layer of insulating material forming a first outer surface; a layer of conductive material forming a second outer surface; at least one electric heating cable disposed between the first and second outer surfaces; and, an electrical connection element for connecting the at least one electric heating cable to a power source. A method of forming a flexible roll-out thermal system, including: disposing at least one electric heating cable between a layer of insulating material forming a first outer surface and a layer of conductive material forming a second outer surface; and connecting an electrical connection element to one end of the at least one electric heating cable, the electrical connection element for connecting the at least one electric heating cable to a power source.

12 Claims, 3 Drawing Sheets

ROLL-OUT THERMAL ENVELOPE ROOF DE-ICING SYSTEM

This application claims the benefit under 35 U.S.C. §119 (e) of U.S. Provisional Application No. 61/375,509 filed on Aug. 20, 2010 which application is incorporated herein by reference.

FIELD OF THE INVENTION

The invention relates generally to heated roll-out system having an integral electric heating system for providing heat to portions of a roof.

BACKGROUND OF THE INVENTION

Failure of snow and ice to slide off known roof coverings such as asphalt or fiber glass shingles or metal panels results in melting snow forming an ice dam at the edge of the roof. The dam prevents snow on the upper portions of the roof from sliding off and can enable water to back up and leak through the roof into the interior of the house. Heavy snow accumulations on the roof may also result in collapse of the roof. Conventional heat tapes or permanently installed heating cables on the exterior surface of the roof provide insufficient heat transfer to completely and effectively remove ice and snow. When the snow and ice do slide off the roof, the heat tape often slides off with it. Permanently installed heating cable on the exterior surface of the roof actually obstructs movement of ice and snow off the roof because of the raised profile of the cable.

A roof and gutter de-icing kit by EGS Electrical Group consists of electric heating cable installed on an exterior surface of a roof covering or in a gutter and attached to the covering or gutter by clips. The use of the clips is time-consuming and increases the cost of the product. Since the clips are exposed, the clips are vulnerable to damage or to being knocked loose or free by ice or snow heaving or sliding on the roof covering. Further, since the cable is on an exterior surface of the cover, the majority of the heat is radiated outward into space, rather than onto the roof covering. Further heat loss is caused by direct exposure of the installed cable to the outside environment, including wind. The cables also can block snow and ice from sliding off the roof or themselves can be knocked off the roof by sliding snow or ice. Since the clips and cable are visible, the clips and cable degrade the aesthetic appearance of the roof covering.

A system sold by Thermal Technologies consists of rigid panel sections that are installed on the exterior of a roof covering. The panels are made of extruded aluminum, greatly increasing the cost of the panels and decreasing the ease of use of the panels, for example, cutting panels to length or otherwise adapting the panels to fit specific configurations. The panels extend above the roof covering, and are therefore, vulnerable to damage or to being knocked loose or free by ice or snow heaving or sliding on the roof covering. Further, since the panel is on an exterior surface of the cover, an undesirable large amount of heat from the panel is radiated outward into space, rather than onto the roof covering. Further heat loss is caused by direct exposure of the panel to the outside environment, including wind. The panels also can block snow and ice from sliding off the roof forming ice dams. The panels themselves also can be knocked off the roof by sliding snow or ice. Since the panels are visible, the panels degrade the aesthetic appearance of the roof covering.

SUMMARY OF THE INVENTION

According to aspects illustrated herein, there is provided a flexible roll-out thermal system, including: a layer of insulating material forming a first outer surface; a layer of conductive material forming a second outer surface; at least one electric heating cable disposed between the first and second outer surfaces; and, an electrical connection element for connecting the at least one electric heating cable to a power source.

According to aspects illustrated herein, there is provided a flexible roll-out thermal system, including: a layer of insulating material forming a first outer surface; a layer of conductive, non-metallic material forming a second outer surface; a layer of reflective metallic material disposed between the first and second outer surfaces; at least one electric heating cable disposed between the second outer surface and the layer of reflective metallic material; a layer of conductive metallic material disposed between the at least one electric heating cable and the second outer surface; and an electrical connection element for connecting the at least one electric heating cable to an electrical power source. The system is bendable along a longitudinal axis for the system such that: at least a portion of the system forms an L-shape; at least a portion of the system forms a U-shape; or a portion of the first outer surface is in contact with a portion of the second outer surface.

According to aspects illustrated herein, there is provided a method of forming a flexible roll-out thermal system, including: disposing at least one electric heating cable between a layer of insulating material forming a first outer surface and a layer of conductive material forming a second outer surface; and connecting an electrical connection element to one end of the at least one electric heating cable, the electrical connection element for connecting the at least one electric heating cable to a power source.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention.

Unless defined otherwise, all technical and scientific terms used herein have the same meaning as commonly understood to one of ordinary skill in the art to which this invention belongs. It should be understood that methods, devices or materials similar or equivalent to those described herein can be used in the practice or testing of the invention.

Figure 1:
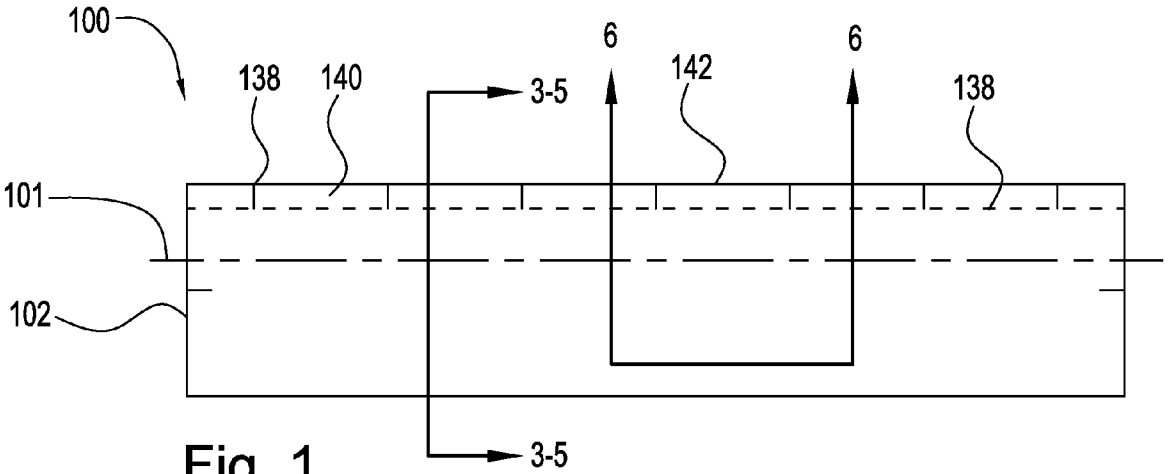
FIG. 1 is a top view of a flexible roll-out thermal system.

FIG. 1 is a top view of flexible roll-out thermal system 100.

Figure 2:
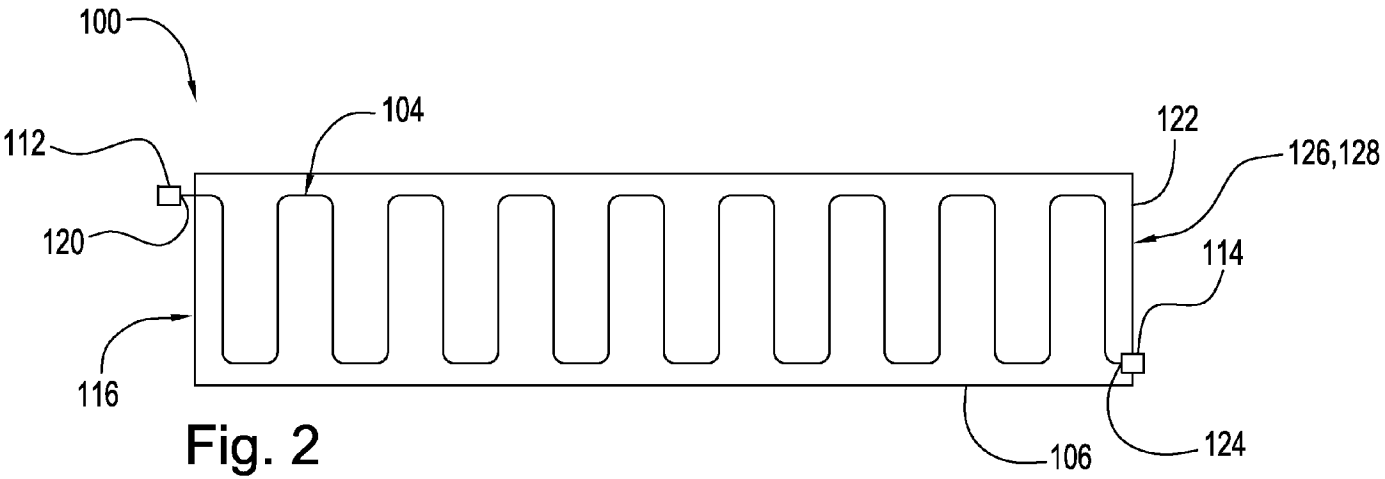
FIG. 2 is a top view of the flexible roll-out thermal system shown in FIG. 1, with one or more layers removed to show at least one electric heating cable.

FIG. 2 is a top view of flexible roll-out thermal system 100 shown in FIG. 1, with one or more layers removed to show at least one electric heating cable.

Figure 3:
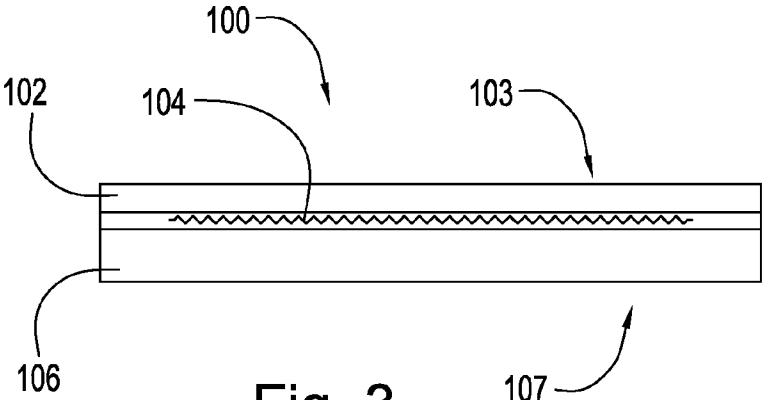
FIG. 3 is an cross-section view of the system shown in FIG. 1 generally along line 3-5-3-5 in FIG. 1 and intersecting the at least one electric heating cable.

FIG. 3 is an cross-section view of system 100 shown in FIG. 1 generally along line 3-5-3-5 in FIG. 1 and intersecting the at least one electric heating cable. By flexible, we mean that the system can be bent to a degree with respect to longitudinal axis 101 for the system. For example, the system can be bent to form an L-shape or a U-shape, or can be bent such that respective surfaces of the system are in contact, as further described below. In one embodiment, the bending is along the axis or orthogonal to the axis. The following should be viewed in light of FIGS. 1 through 3. In one embodiment, system 100 includes layer 102 of thermal conductive material forming outer surface 103 for the system, at least one electric heating cable 104, and thermal insulation layer 106 forming outer surface 107 for the system. Layer 102 is any flexible heat conductive material known in the art. In one embodiment, layer 102 is formed of a metallic material, for example, aluminum. In one embodiment, layer 102 is formed of a non-metallic material, for example, a plastic material, providing a tougher, more durable surface. Layer 106 can be any flexible fire resistant thermal insulation material known in the art.

Cable 104 can be any electrical heating cable known in the art. In an example embodiment, cable 104 is self-regulating or is thermostatically controlled. Cable 104 can have any power rating known in the art. In general, the power rating of the cable can be determined according to the construction of system 100, desired operating parameters, and applicable safety codes. In one embodiment, cables 104 are bonded to one or both of the layers in contact with the cables, for example, layers 102 or 106, using any means known in the art. System 100 includes electrical connection element 112 electrically connected to cable 104 and used to connect the cable to a power supply, for example, a 120 VAC system for a building upon which system 100 is installed. Element 112 can be any power connection element, compatible with the remainder of system 100, known in the art. For an installation using a plurality of assemblies 100, hereafter referred to as "segments," each segment can be separately connected to a power supply via a respective connection element 112. In one embodiment, cable 104 operates at 120 VAC; however, it should be understood that cable 104 can operate at other voltage levels and voltage types, for example, direct current, and at various power levels.

Waterproof connection elements 114 are used to connect heating cables for adjacent segments, for example, element 112 for one segment is electrically connected to element 114 for the adjacent segment, or to complete the electrical circuit for cable 104 when system 100 is cut to length. For example, a segment includes end 116, with respect to longitudinal axis 118 for the system, and cable 104 includes end 120 connected to the electrical connection element. Cable 104 and layers 102 and 106 are arranged to be cut along a line, for example, line 122 crossing the axis, to form respective ends 124, 126, and 128. The power connection element is arranged to be connected to end 124 of the cable to complete an electrical circuit formed by the cable. For example, cutting the cable severs the conductors carrying electrical current through the cable and element 114 is used to re-connect the severed conductors to complete the power circuit for the cable. Elements 114 can be any electrical connection element, compatible with cables 104, known in the art. As noted above, a first segment of system 100 can be connected to a power supply by element 112 and one or more additional segments can be powered by this segment via respective elements 112 electrically connected to element 114 for the first segment.

Figure 4:
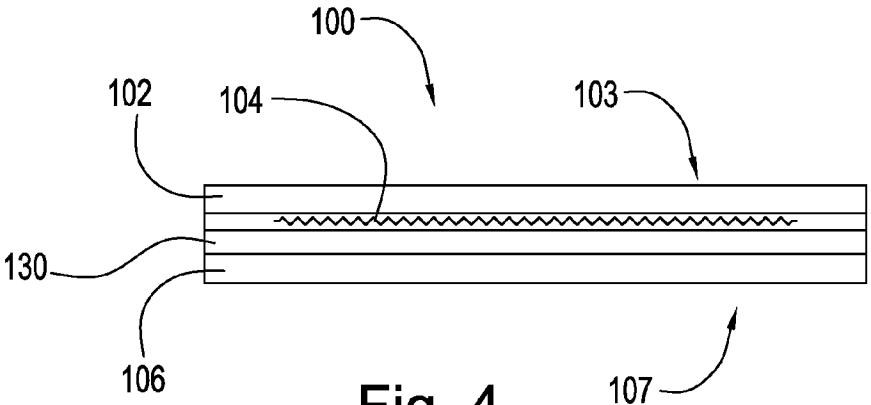
FIG. 4 is an cross-section view of the system shown in FIG. 1, with a reflective layer, generally along line 3-5-3-5 in FIG. 1 and intersecting the at least one electric heating cable.

FIG. 4 is an cross-section view of system 100 shown in FIG. 1, with reflective layer 130, generally along line 3-5-3-5 in FIG. 1 and intersecting the at least one electric heating cable 104. In one embodiment, system 100 includes layer 130 disposed between cable 104 and layer 106. In one embodiment, layer 130 is a sheet or sheets of any flexible heat reflective material known in the art and reflects heat from the cables back toward the top layer. In one embodiment, layers 106 and 130 are joined by any means known in the art. In one embodiment, layers 106 and 130 are formed as a single unit.

Figure 5:
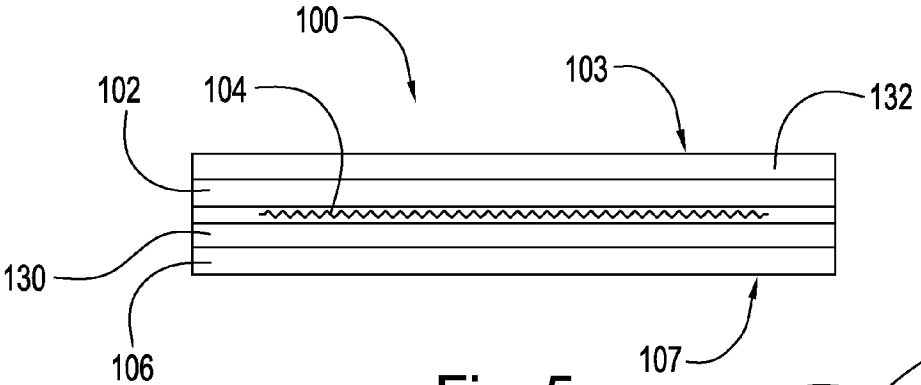
FIG. 5 is an cross-section view of the system shown in FIG. 1, with an additional conductive layer and a reflective layer, generally along line 3-5-3-5 in FIG. 1 and intersecting the at least one electric heating cable; and, FIG. 6 is a cross-section view of the system shown in FIG. 1 generally along line 6-6 in FIG. 1, intersecting the at least one electric heating cable, and rolled along a longitudinal axis.

FIG. 5 is an cross-section view of system 100 shown in FIG. 1, with reflective layer 130 and additional thermal conductive layer 132, generally along line 3-5-3-5 in FIG. 1, and intersecting the at least one electric heating cable. In one embodiment, system 100 includes layers 130 and 132. Layer 132 forms outer surface 103. The discussion for FIG. 4 regarding layer 130 is applicable to layer 130 in FIG. 5. In one embodiment, layer 132 is formed from a metallic material. In one embodiment, layer 132 is formed of a non-metallic material, for example, a plastic material, providing a tougher, more durable surface.

Figure 6:
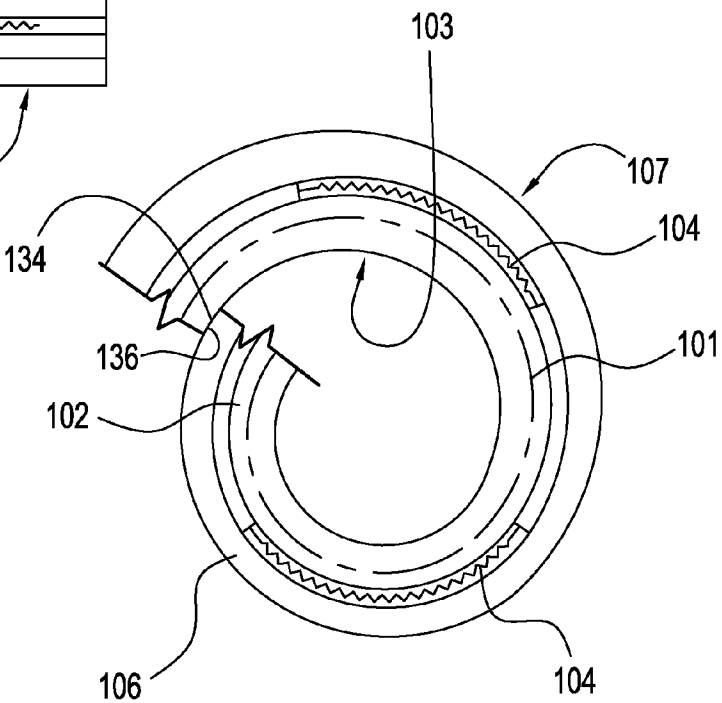

FIG. 6 is an cross-section view of system 100 shown in FIG. 1 generally along line 6-6 in FIG. 1, intersecting electric heating cable 104, and rolled along longitudinal axis 101. The following should be viewed in light of FIGS. 1 through 6. In one embodiment, system 100 is sufficiently flexible to enable the system to be tightly rolled for transportation and storage, for example, as shown in FIG. 6. For example, the system is rollable along the longitudinal axis such that portion 134 of outer surface 103 is in contact with portion 136 of outer surface 107. System 100 can be rolled out for installation as described infra.

In one embodiment, system 100 is a complete integrated unit requiring no further assembly. The heating cables, having a safe wattage rating, are bonded at the factory to one or all of layers 102, 106, or 130. Layer 106 and layers 130 can be bonded together. Layer 106 of fire resistant flexible insulation provides an insulating barrier to minimize heat loss.

System 100 has an envelope, or sandwich, construction and uses electrical heat cables 104 installed inside an envelope, or sandwich, formed by the combinations of layers 102, 106, 130, or 132 shown in the figures. The sandwich construction and design reflects heat to the top side of the envelope in contact with a roof covering, that is, surface 103. System 100 is fabricated to be flexible, for example, in a roll-out form, for easy application under asphalt shingles, metal panels, or other conventional roof coverings along the leading (soffit) edge of a roof. System 100 may be applied prior to the installation of roof covering as well as after such installation by, for example, by lifting or removing the first row or rows of shingles or panels and inserting the system under the lifted shingles or panels or in the location of the removed shingles or panels. Heat transfer from system 100 to the asphalt shingles, metal panels, or other conventional roof coverings melts ice and snow on the roof covering and forms a lubricating layer of water on the roof covering that aids in the displacement of the ice and snow in the same fashion as a glacier moves over the ground. Once ice and snow are removed along the leading edge of the roof, the remaining ice and snow on the entire pitch of the roof is free to fall off of its own accord. In extremely cold climates, installation of a second row of the system may be prudent. Once installed, system 100 is completely out of sight and aesthetically pleasing.

In one embodiment, system 100 is a factory sealed sandwich type construction consisting of heating cables bonded between the layers shown in the figures, for example, layers 102 and 106, or layers 130 and 102. Layer 106 can safely contact the bare surface of the roof structure or intermediate material, such as tar paper. In an example embodiment, contact adhesive is applied, for example, during fabrication of the system, to surface 107 such that the system adheres to the roof structure during installation to facilitate installation. For example, a single person can install lengths of system 100 since the system remains in position once placed upon the roof, eliminating the need for a second person to hold the system. Further, ongoing adjustments can be easily made prior to permanently attaching the system.

In an example embodiment, the heating cables operate on 120 VAC power from a panel board for the building upon which the system is installed and are engineered for a safe but effective wattage rating. The heating cables run continuously through the system and are cut at the point the system is cut (to match the portion of the roof to which the system is being attached) and are rejoined using waterproof junction connector 114 to restore the circuit. In contrast to existing roof de-icing systems, system 100 more robustly disperses heat over a broader area of the roof cover, for example, shingles or metal panel, resulting in more efficient ice and snow removal at the leading edge of the roof. This removal enables full cascading of ice and snow from the entire roof.

System 100 can be installed only on the leading edge of a roof, or additional rows of system 100 can be installed up toward the ridgeline of the roof to increase heat transfer to better facilitate ice and snow melting and removal. System 100 also can be installed in roof valleys, for example, prior to installation of the roof covering. The system can be sized as needed, for example, made narrower, as needed for valley installations.

As noted above, existing roof deicing systems, for example, those using heating cables stapled with clips onto the exterior surfaces of the leading edge of the roof, function inefficiently, and at best only melt or partially melt ice dams at the edge of the roof. In contrast, system 100 functions much more efficiently, uniformly, and effectively and can be used to clear all or portions or a roof. For example, the top layer of system 100, which transfers heat directly to the roof covering, is protected from wind and insulated from cold by virtue of the roof covering overlaying the system. Thus, more heat is directly transferred to the roof covering rather than being dissipated by wind chill affects or direct exposure to cold outside air.

In one embodiment, system 100 is any length or width known in the art corresponding to a standard overlap area for a shingle roof or other conventional roof covering. In one embodiment, system 100 is any standard length or width known in the art. In one embodiment, the length or width of system 100 can be made greater or less than a standard length or width. Although a particular shape and configuration are shown for system 100, it should be understood that other shapes and configurations are possible for system 100.

In one embodiment, system 100 includes a graphical representation to help delineate the position of the heating cable. The representations can be, for example, markers 138 and/or color coding. Knowing the position of the heating cables, which are not necessarily visible in the completed system 100, can help prevent installers from penetrating the cables when installing the system and/or roof covering. For example, some fasteners used to attach the roof covering to the roof structure pass must pass through the system, and can be used to secure the system to the roof structure. By knowing the position of the cable, an installer can position fasteners to avoid the cables. The markers can indicate space 140 between the cable and lateral edge 142 or can indicate the position of sections of the cable parallel to axis 118. Space 140 could be colored coded different from the remaining surface 103.

System 100 has at least the following advantages:

1. Conductive layers 102 and 132 provide uniform distribution of heat across surface 103.
2. Can be used with new construction, but is thin enough to be inserted under existing roof coverings such as shingles and metal roof panels.
3. Does not require special tools or fasteners, such as clips. In addition to the contact adhesive aspects, can be fastened to the roof structure using the same type of fasteners used for the roof covering and in some cases the same fasteners used to secure both the system and the roof covering. That is, redundant or separate fastening operations are not needed.
4. Adhesive backing simplifies application and reduces labor requirements, while enabling ongoing adjustment prior to final fastening to the roof structure.
5. Aesthetically pleasing in that the system is not visible once installed (system is placed under the roof covering).
6. Since the system is under the roof covering, the system does not provide an obstacle to snow or ice sliding off the roof, as is the case for heating systems applied to the exterior of the roof covering.
7. Energy efficient design minimizes heat loss to the surrounding environment, while directing the optimal amount of heat from the cables to the roof covering.
8. Marking, such as color coding, notching, or other surface marks enables safe placement of panel to avoid penetration of heating cable by fasteners used to secure the roof covering to the roof structure
9. Envelope type construction with a combination of insulation, reflective materials, heat conducting materials, and heat absorbing materials insures efficient and uniform heat distribution over entire pad surface resulting in complete melting of ice and snow above pad Thus, it is seen that the objects of the invention are efficiently obtained, although changes and modifications to the invention should be readily apparent to those having ordinary skill in the art, without departing from the spirit or scope of the invention. Although the invention is described by reference to various embodiments, it is clear that variations can be made without departing from the scope or spirit of the invention.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art.

What I claim is:

1. A flexible roll-out thermal system, comprising:

a layer of thermal insulating material forming a first outer surface;

at least one layer of flexible thermal conductive material forming a second outer surface;

at least one electric heating cable disposed between the first and second outer surfaces; and, an electrical connection element for connecting the at least one electric heating cable to a power source, wherein:

the at least one layer of thermal conductive material is formed of a metallic material; and, the system is rollable along a longitudinal axis for the system such that a portion of the first outer surface is in contact with a portion of the second outer surface.

2. The system of claim 1 further comprising a layer of reflective material disposed between the first outer surface and the at least one electric heating cable.

3. The system of claim 2 wherein the layer of reflective material is formed of a metallic material.

4. The system of claim 1 wherein the system is bendable such that:

at least a portion of the system forms an L-shape; or, at least a portion of the system forms a U-shape.

5. The system of claim 1 further comprising:

a first end with respect to a longitudinal axis for the system; and, a power connection element, wherein:

the at least one electric heating cable includes a first end connected to the electrical connection element;

the at least one electric heating cable, the layer of thermal insulating material, and the at least one layer of flexible, metallic thermal conductive material are arranged to be cut along a line crossing the axis to form respective second ends; and, the power connection element is arranged to be connected to the second end of the at least one electric heating cable to:

complete an electrical circuit formed by the at least one electric heating cable; or, be connected to an electrical connection element for an additional flexible roll-out thermal system.

6. A flexible roll-out thermal system, comprising:

a layer of thermal insulating material forming a first outer surface;

a layer of thermal conductive non-metallic material forming a second outer surface;

a layer of reflective metallic material disposed between the first and second outer surfaces;

at least one electric heating cable disposed between the second outer surface and the layer of reflective metallic material;

a layer of flexible thermal conductive metallic material disposed between the at least one electric heating cable and the second outer surface; and, an electrical connection element for connecting the at least one electric heating cable to an electrical power source, wherein the system is rollable along a longitudinal axis for the thermal system such that a portion of the first outer surface is in contact with a portion of the second outer surface.

7. The system of claim 6 further comprising:

a first end with respect to a longitudinal axis for the system; and, a power connection element, wherein:

the at least one electric heating cable includes a first end electrically connected to the electrical connection element;

the at least one heating cable, the layer of thermal insulating material, the layer of thermal conductive non-metallic material, the layer of flexible thermal conductive metallic material, and the layer of reflective metallic material are arranged to be cut, along a line crossing the axis, to form respective second ends; and, the power connection element is arranged to be connected to the second end of the at least one electric heating cable to complete an electrical circuit formed by the at least one electric heating cable.

8. A method of forming a flexible roll-out thermal system, comprising:

disposing at least one electric heating cable between a layer of thermal insulating material forming a first outer surface and at least one layer of flexible, metallic thermal conductive material forming a second outer surface; and, connecting an electrical connection element to one end of the at least one electric heating cable, the electrical connection element for connecting the at least one electric heating cable to a power source, wherein the system is rollable along a longitudinal axis for the system such that a portion of the first outer surface is in contact with a portion of the second outer surface.

9. The method of claim 8 further comprising disposing a layer of reflective material between the first outer surface and the at least one electric heating cable.

10. The method of claim 9 wherein the layer of reflective material is formed of a metallic material.

11. The method of claim 8 further comprising overlaying a layer of thermal conductive material with a layer of non-metallic thermal conductive material to form the at least one layer of thermal conductive material and the second outer surface.

12. The method of claim 8 wherein the system is bendable along a longitudinal axis for the system such that:

at least a portion of the system forms an L-shape; or, at least a portion of the system forms a U-shape.

* * * * *